US009783213B2

(12) United States Patent
Gloyd et al.

(10) Patent No.: US 9,783,213 B2
(45) Date of Patent: Oct. 10, 2017

(54) IMPACT RESISTANT END OF TRAIN DEVICE

(71) Applicant: Wabtec Holding Corp., Wilmerding, PA (US)

(72) Inventors: D. Andrew Gloyd, Ellicott City, MD (US); John E. Halowell, Montgomery Village, MD (US); David McCary, West Windsor, NJ (US); Benjamin Henniges, Mt. Airy, MD (US)

(73) Assignee: Wabtec Holding Corp., Wilmerding, PA (US)

( * ) Notice: Subject to any disclaimer, the term of this patent is extended or adjusted under 35 U.S.C. 154(b) by 175 days.

(21) Appl. No.: 14/432,608

(22) PCT Filed: Oct. 4, 2013

(86) PCT No.: PCT/US2013/063342

§ 371 (c)(1),
(2) Date: Mar. 31, 2015

(87) PCT Pub. No.: WO2014/055804

PCT Pub. Date: Apr. 10, 2014

(65) Prior Publication Data

US 2015/0259001 A1 Sep. 17, 2015

Related U.S. Application Data

(60) Provisional application No. 61/710,291, filed on Oct. 5, 2012.

(51) Int. Cl.

| | |
|---|---|
| ***B65D 1/24*** | (2006.01) |
| ***B61G 7/14*** | (2006.01) |
| ***B61L 15/00*** | (2006.01) |

(52) U.S. Cl.
CPC ..... *B61L 15/0054* (2013.01); *B61G 7/14* (2013.01)

(58) Field of Classification Search
CPC ... B65D 1/00; B65D 1/22; B65D 1/24; B65D 1/40; B65D 9/00; B65D 9/06; B65D 11/00; B65D 13/00
See application file for complete search history.

(56) References Cited

U.S. PATENT DOCUMENTS

| | | | | |
|---|---|---|---|---|
| 3,809,002 | A | 5/1974 | Nagy et al. | |
| 4,665,858 | A * | 5/1987 | Harrigal | B60Q 1/30 116/202 |
| 5,454,477 | A | 10/1995 | Bornhorst et al. | |
| 6,327,940 | B1 | 12/2001 | Price | |

(Continued)

*Primary Examiner* — R.J. McCarry, Jr.
(74) *Attorney, Agent, or Firm* — The Webb Law Firm

(57) ABSTRACT

An end of train device includes an enclosure having an exterior and a hollow interior housing a plurality of components; and a protective arrangement disposed within the hollow interior of the enclosure and fitted at least partially around at least one component housed within the hollow interior. The protective arrangement defines at least one compartment for the at least one component of the plurality components. The protective arrangement at least partially supports and isolates the at least one component from the enclosure. The device also includes an impact resistant handle disposed on the exterior of the enclosure. The handle is configured to absorb impacts without causing substantial deformation to the enclosure.

32 Claims, 8 Drawing Sheets

(56) References Cited

U.S. PATENT DOCUMENTS

| | | | | |
|---|---|---|---|---|
| 6,695,141 | B2 * | 2/2004 | Kropf | B65D 85/38 206/320 |
| 6,954,967 | B2 | 10/2005 | Park et al. | |
| 7,520,389 | B2 | 4/2009 | Lalouette | |
| 2007/0187283 | A1 | 8/2007 | Otsuka et al. | |
| 2011/0011760 | A1 * | 1/2011 | Habersetzer | G06F 1/1628 206/320 |
| 2011/0068035 | A1 | 3/2011 | Egan et al. | |

* cited by examiner

IMPACT RESISTANT END OF TRAIN DEVICE

BACKGROUND OF THE INVENTION

Field of the Invention

The present invention relates to an end of train device (BUT) for connection to the coupler on a railcar. More specifically, the present invention relates to an EOT that includes a protective arrangement fitted around the internal components of the EOT and an impact resistant handle, such that the EOT and its internal components are protected from impacts and vibration.

Description of Related Art

End of train devices (EOTs) are generally a combination of electronic, mechanical, and pneumatic components packaged in an enclosure to protect them from damage due to weather, everyday use, and rough handling, which are connected to the coupler on a railcar. The internal components are attached to the housing, and thus the coupler, through a rigid connection to the housing of the EOT. However, the coupler of the railcar is a very high vibration environment, and because the internal components are rigidly connected to the EOT, a significant amount of vibration is transmitted to the sensitive internal components, resulting in component wear, fatigue, and failure. Also, EOTs are often subject to rough handling and dropping during transport and mounting by personnel.

The internal components are sometimes attached to the enclosure using rubber shock mounts to reduce vibration and shock transferred to the internal components. The shock mounts are rigidly attached to the internal component and to the enclosure of the EOT with a flexible material, such as rubber, disposed in between. This method is effective but has the drawback that any damage to the enclosure of the EOT can disrupt the internal support provided to the internal components. Further, the shock mounts are not effective equally in all directions and are located at relatively few points, which incur high point loads during an impact.

Further, EOTs are portable and, thus, usually incorporate a handle. The handles are made from a rigid material, such as plastic or aluminum. This type of handle is prone to damage, and may cause permanent deformation and damage to the EOT by transmitting all of the impact energy directly to the enclosure of the EOT when the EOT is dropped or struck. The handle can be permanently bent or broken, as well as bending or breaking the EOT at the attachment point.

SUMMARY OF THE INVENTION

Accordingly, there is a general need in the art for an impact resistant end of train (EOT) device that incorporates a packing system that protects the internal components of the EOT from vibrations introduced at the mounting to the railcar and from damage incurred from all directions, even when the enclosure of the EOT is damaged or deformed. There is also a general need in the art for such an EOT that incorporates an impact resistant handle.

According to one embodiment, the impact resistant EOT incorporates an arrangement of foam packing that involves using one or several pieces of resilient foam material to be placed between the internal components and the enclosure to locate, support, and protect the components. For instance, the EOT may include three main components that are isolated using two pieces of foam for each. This arrangement better isolates the internal components from external damage, improves effectiveness in all directions, and more evenly distributes impact loads, reduces or eliminates hardware, such as fasteners and brackets, and reduces weight. Further, this arrangement increases the surface area of support for the internal components, distributing the load more evenly, and reducing the potential for damage to the internal components.

The foam pieces may be formed to fit around the internal components, and the enclosure is designed to accept the foam pieces. Features in the enclosure hold the foam pieces in the proper location without the use of fasteners, such as needed in traditional shock mounts, such that the enclosure is free to deflect without damaging the internal components. The foam pieces can vary in density or stiffness to customize the isolation properties. The properties within a given foam piece may also be varied. The particular foam packing utilized in connection with the EOT may be selected to be lightweight, moisture resistant, impact resistant, electrically isolating, resilient, transparent to radio frequencies, and have varying stiffness in different areas.

According to another embodiment, the EOT includes an impact resistant handle disposed on the enclosure that is constructed of a tough but flexible material chosen to provide sufficient support for carrying the EOT and mounting the EOT to the coupler, while remaining flexible enough to absorb impacts. The handle may flex under impact but will return to its original shape, thus avoiding permanent damage. A handle so constructed acts as a shock absorber to protect the EOT. The handle may also be constructed such that it is not electrically conductive and does not affect radio frequency transmission or reception. The handle may also be abrasion and wear resistant.

The handle is dimensioned and fashioned as a typical carrying handle, with consideration given to the size and weight of the device to which it is attached, and for human comfort. The softer material has the added benefit of better perceived comfort and ergonomics. The attachment points are reinforced by bonding or molding in a local reinforcing bushing of metal or other suitably strong material.

According to one preferred and non-limiting embodiment of the invention, an end of train device is provided. The end of train device includes an enclosure having an exterior and a hollow interior housing a plurality of components; and a protective arrangement disposed within the hollow interior of the enclosure and fitted at least partially around at least one component housed within the hollow interior. The protective arrangement defines at least one compartment for the at least one component of the plurality of components. The protective arrangement at least partially supports and isolates the at least one component of the plurality of components from the enclosure.

The protective arrangement may define a compartment for each component of the plurality of components.

According to one alternative to the preferred and non-limiting embodiment, the protective arrangement includes at least one piece of packing. The at least one piece of packing may be formed from closed cell polyethylene foam.

According to another alternative to the preferred and non-limiting embodiment, the protective arrangement includes a plurality of pieces of packing. The plurality of pieces of packing may include at least two pieces of packing for the at least one component of the plurality of components. The at least two pieces of packing define the at least one compartment. Each piece of the plurality of pieces of packing is individually configured to be at least partially fitted around a respective component, to cooperatively engage at least one other piece of packing in the enclosure, and to cooperatively engage at least a portion of the hollow interior of the enclosure to support the respective component within the hollow interior.

At least one piece of the plurality of pieces of packing may have a different density than at least one other piece of packing of the plurality of pieces of packing. Particularly, at least one piece of packing positioned at a lower end of the hollow interior of the enclosure may have a higher density than at least one piece of packing positioned at an upper end of the hollow interior of the enclosure.

The protective arrangement may be configured to accommodate ancillary components of the end of train device. The protective arrangement may include at least one groove for accommodating wires within the hollow interior of the enclosure.

According to yet another alternative to the preferred and non-limiting embodiment, the end of train device further includes an impact resistant handle disposed on the exterior of the enclosure, the handle configured to absorb impacts without causing substantial deformation to the enclosure. The handle may be formed from a flexible material, such as polyurethane. The handle includes at least one hole disposed at each end, each hole having a reinforcement bushing disposed therein for fastening the handle to the exterior of the enclosure.

The hollow interior of the enclosure may include elements for engaging the protective arrangement to maintain a position of the protective arrangement within the hollow interior of the enclosure.

According to another preferred and non-limiting embodiment of the invention, a method of supporting a plurality of components within an end of train device is provided. The method includes the steps of providing an enclosure having an exterior and a hollow interior housing the plurality of components; providing a protective arrangement disposed within the hollow interior of the enclosure, the protective arrangement defining at least one compartment for at least one component of the plurality of components; fitting the protective arrangement at least partially around the at least one component housed within the hollow interior; supporting the at least one component within the hollow interior of the enclosure with the protective arrangement; and isolating the at least one component within the hollow interior of the enclosure from the enclosure with the protective arrangement.

According to an alternative to the preferred and non-limiting embodiment, the step of providing a protective arrangement includes providing at least two pieces of foam packing for the at least one component and the fitting step includes fitting the at least two pieces of foam packing at least partially around the at least one component of the plurality of components to define the at least one compartment for the at least one component.

According to another alternative to the preferred and non-limiting embodiment, the method further includes the step of individually configuring each piece of packing to be fitted around the at least one component, to cooperatively engage at least one other piece of packing in the enclosure, and to cooperatively engage at least a portion of the hollow interior of the enclosure to support the at least one component within the hollow interior.

According to yet another alternative to the preferred and non-limiting embodiment, the method further includes the step of selecting a particular density for each piece of packing such that pieces of packing positioned at a lower end of the hollow interior of the enclosure have a higher density than pieces of packing positioned at an upper end of the hollow interior of the enclosure. The method may alternatively include the step of selecting a particular density for each piece of packing in accordance with specific vibration characteristics of the end of train device and the plurality of components.

According to yet another preferred and non-limiting embodiment of the present invention, an end of train device is provided. The end of train device includes an enclosure having an exterior and a hollow interior housing a plurality of different components; and a protective arrangement disposed within the hollow interior of the enclosure and fitted around each different component housed within the hollow interior. The protective arrangement defines a compartment for each different component of the plurality of different components. The protective arrangement completely supports and isolates each different component of the plurality of different components from the enclosure.

According to an alternative to the preferred and non-limiting embodiment, the protective arrangement includes at least one piece of packing. The at least one piece of packing may be formed from closed cell polyethylene foam.

According to another alternative to the preferred and non-limiting embodiment, the protective arrangement includes a plurality of pieces of packing. The plurality of pieces of packing may include at least two pieces of packing for each different component of the plurality of different components. The at least two pieces of packing for each different component of the plurality of different components may be fitted around each different component of the plurality of different components to define the compartment for each different component of the plurality of different components.

Each piece of the plurality of pieces of packing may be individually configured to be fitted around a respective different component, to cooperatively engage at least one other piece of packing in the enclosure, and to cooperatively engage the hollow interior of the enclosure to support the respective different component within the hollow interior.

The plurality of pieces of packing may have different densities. Particularly, pieces of packing positioned at a lower end of the hollow interior of the enclosure have a higher density than pieces of packing positioned at an upper end of the hollow interior of the enclosure.

The hollow interior of the enclosure may include elements for engaging the protective arrangement to maintain a position of the protective arrangement within the hollow interior of the enclosure.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF PREFERRED EMBODIMENTS

Figure 1:
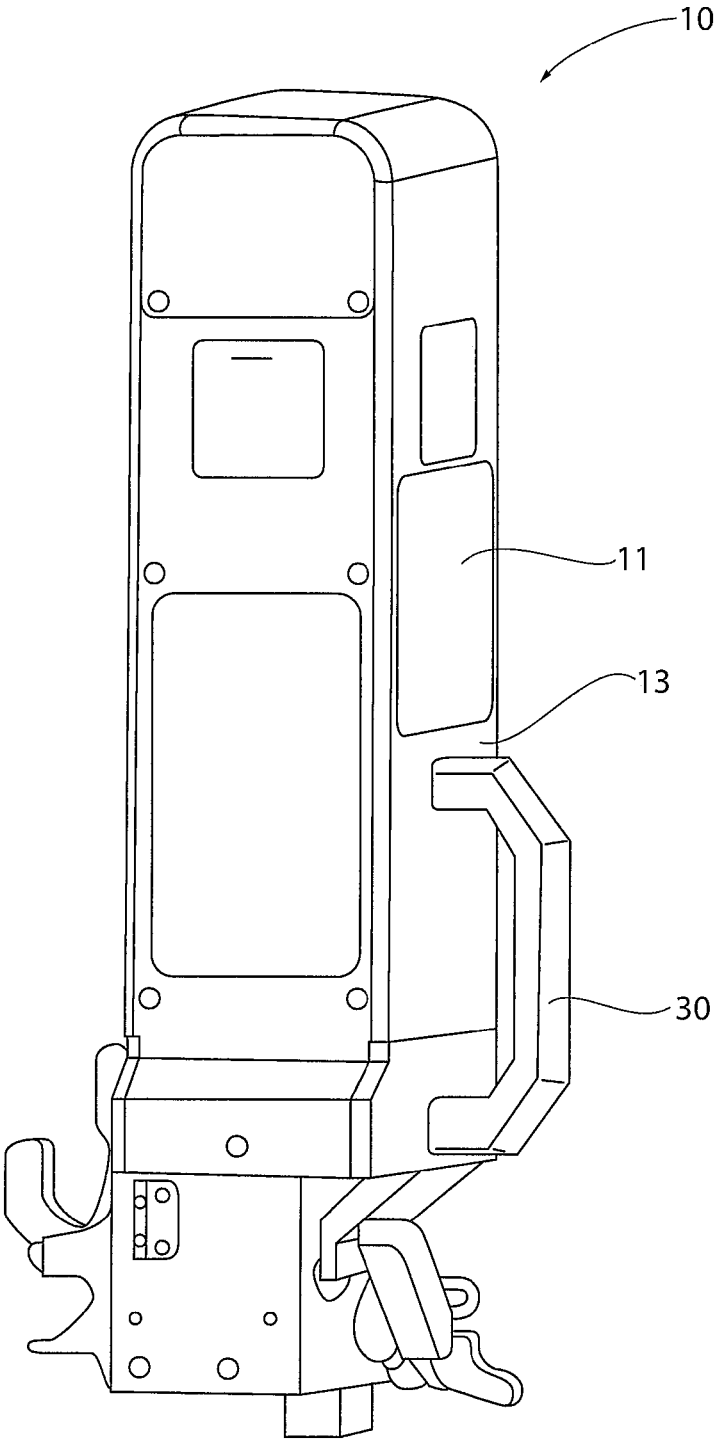
FIG. 1 is a perspective view of an end of train device according to a preferred and non-limiting embodiment of this disclosure.

For purposes of the description hereinafter, the spatial orientation terms, such as "end", "upper", "lower", "right", "left", "vertical", "horizontal", "top", "bottom", "lateral", "longitudinal" and derivatives thereof, if used, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention and should not be considered as limiting. Hence, specific dimensions and other physical characteristics related to the embodiments disclosed herein are not to be considered as limiting. Further, it is to be understood that the invention may assume various alternative variations and step sequences, except where expressly specified to the contrary.

Figure 2:
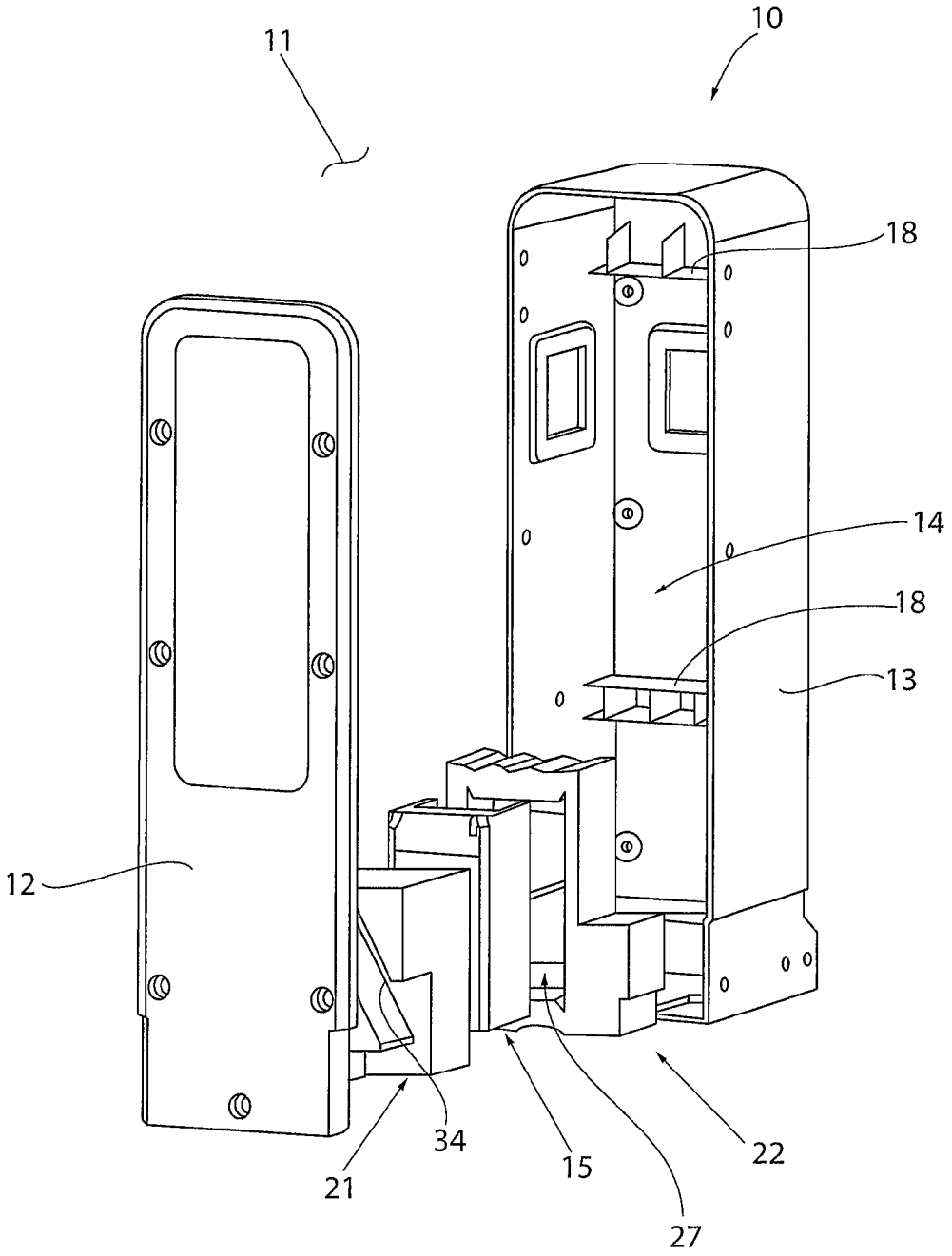
FIG. 2 is an exploded perspective view of the end of train device of FIG. 1.

FIGS. 1 and 2 illustrate an end of train device (EOT) 10 configured to be mechanically fastened to at least one end of a rail car, in particular for attachment to a coupler on a rail car, according to an embodiment of the present invention. The EOT 10 includes an enclosure 11 including a lid 12 and a base body 13, which define an exterior of the enclosure 11, and a hollow interior 14 accessible by removing the lid 12 from the base body 13. The lid 12 may be removably fastened or otherwise secured to the base body 13 to allow for access to the hollow interior 14 of the enclosure 11. The enclosure 11 may be made from a variety of materials, including various metals and plastics.

With reference to FIGS. 2-6, a plurality of different internal components, such as a battery 15, a generator 16, and an electronics module 17 may be disposed within the hollow interior 14 of the enclosure 11. A protective arrangement 20 that includes at least one piece of packing, which may be formed as a piece of shaped resilient material, is also disposed within the hollow interior 14 of the enclosure 11. The protective arrangement 20 is fitted at least partially around each of the different components 15, 16, 17 housed within the hollow interior 14 of the enclosure 11. In particular, the protective arrangement 20 is fitted fully around each of the plurality of components 15, 16, 17. The protective arrangement 20 defines a first compartment 27 for the battery 15, a second compartment 28 for the generator 16, and a third compartment 29 for the electronics module 17. As shown in FIGS. 3-6, the protective arrangement 20 at least partially supports and isolates the different components 15, 16, 17 from the surrounding enclosure 11 within the respective compartments 27, 28, 29. In particular, the protective arrangement 20 completely supports and isolates the different components 15, 16, 17 from the surrounding enclosure 11. It is to be appreciated that the term "different components" as used herein refers to at least two components that are not structurally and/or functionally equivalent to each other, although more than one of the same component may be housed within hollow interior 14 of the enclosure 11 and supported by the arrangement 20. It is also to be appreciated that the battery 15, the generator 16, and the electronics module 17 are described herein as exemplary components. The enclosure 11 of the EOT 10 may be used to house any number of various components according to the purpose and configuration of the EOT 10.

Figure 3:
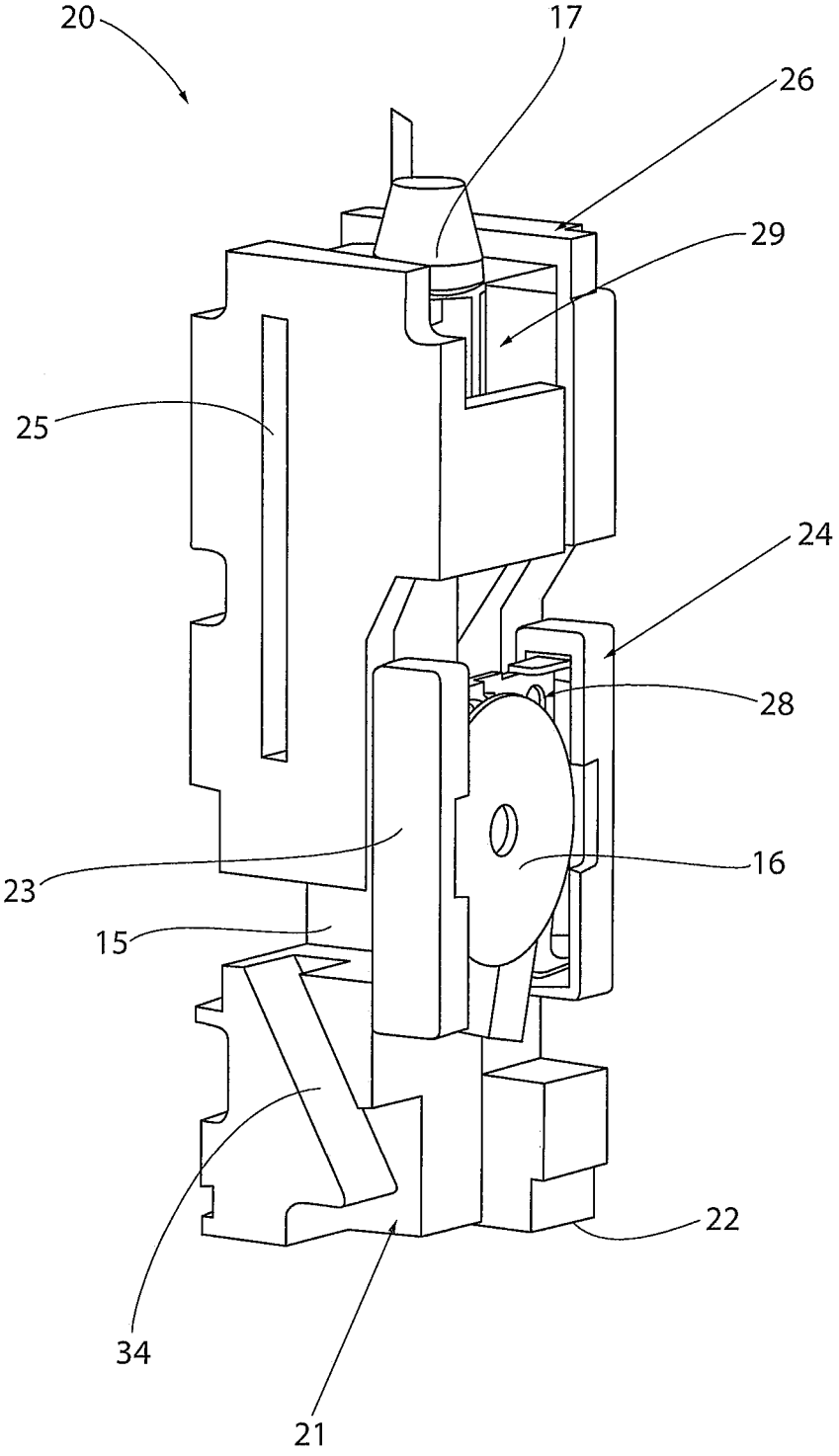
FIG. 3 is a perspective view of an arrangement of foam packing and internal components of the end of train device of FIG. 1.
Figure 4:
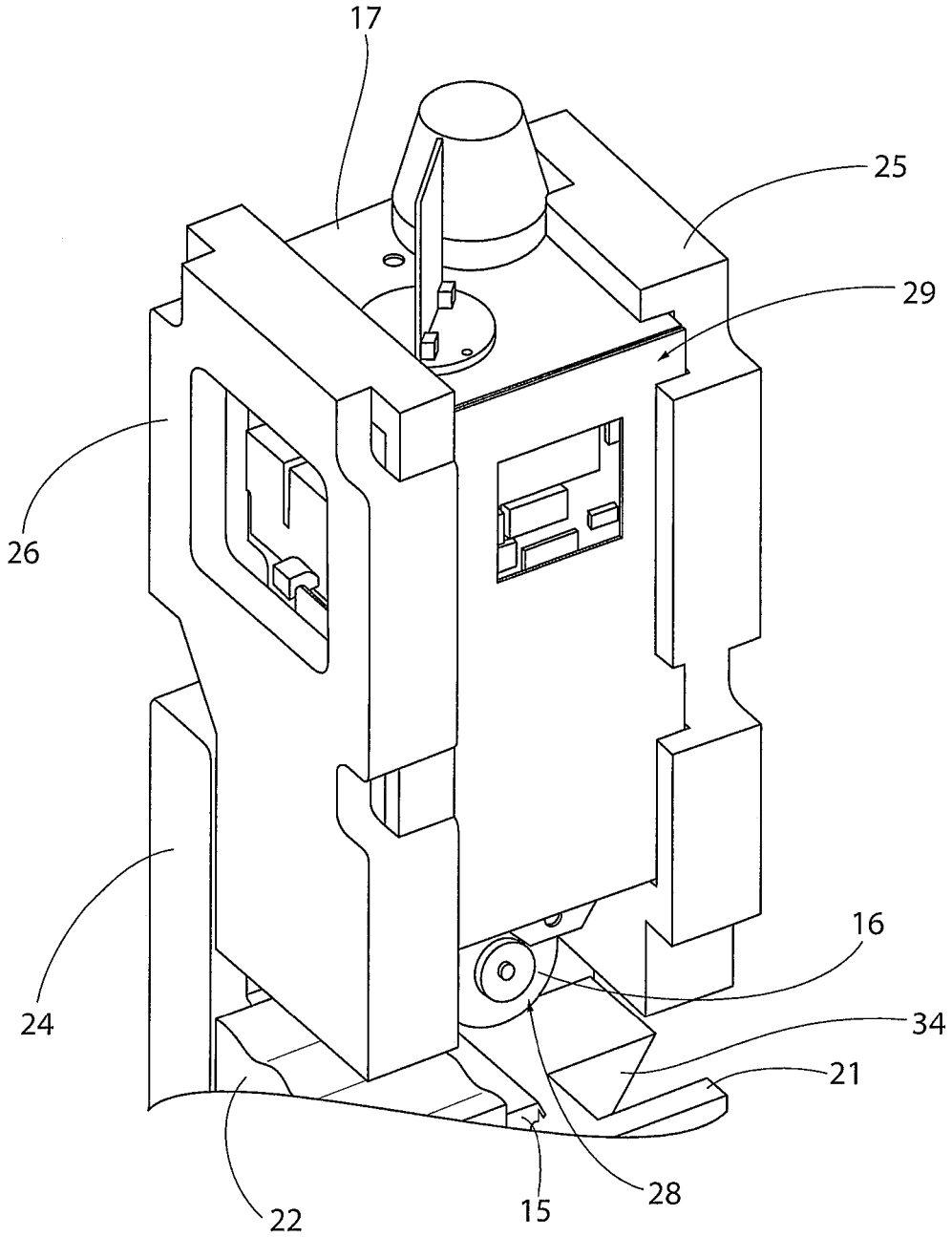
FIG. 4 is a perspective view of an upper portion of the arrangement of foam packing and internal components of FIG. 3.
Figure 5:
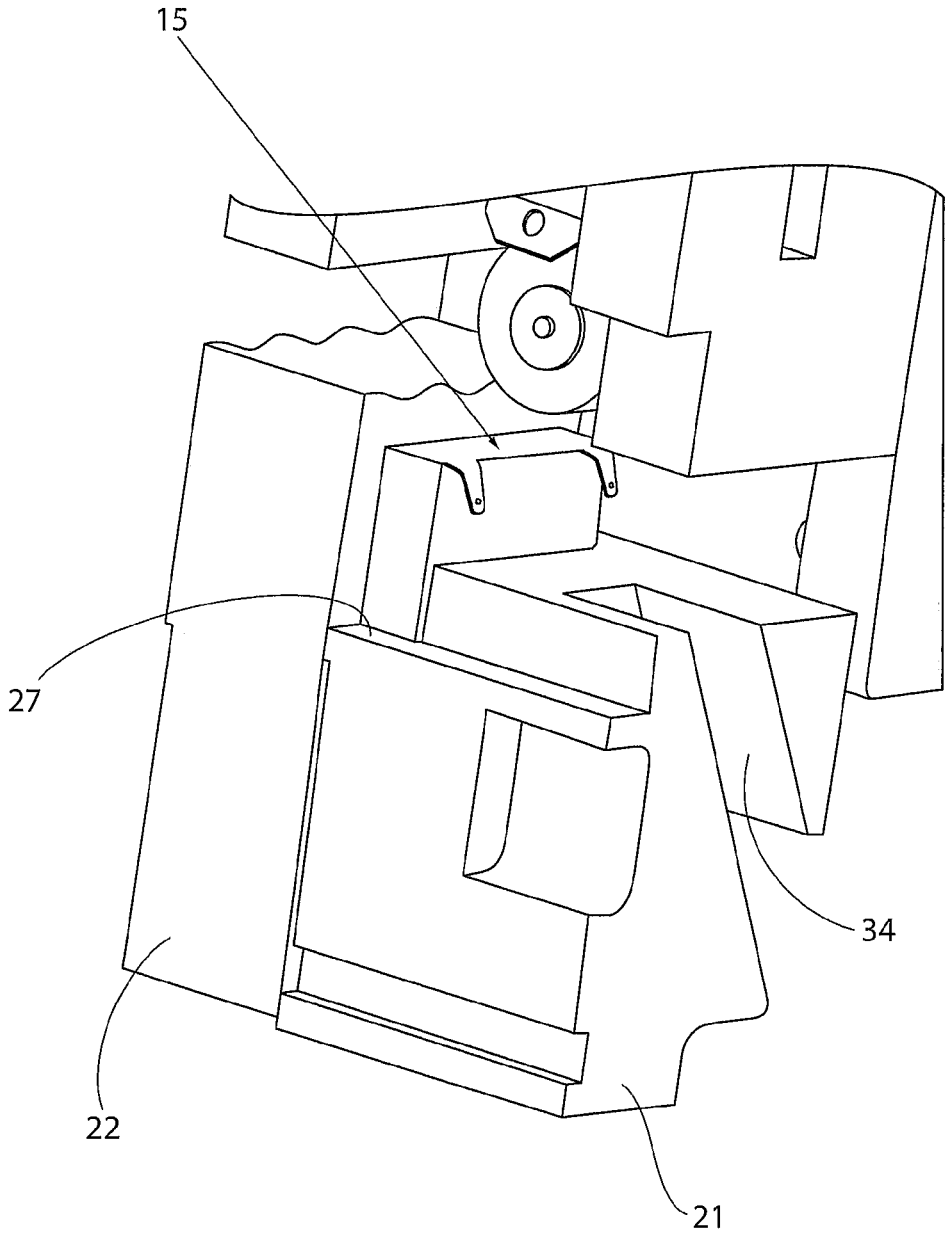
FIG. 5 is a perspective view of a lower portion of the arrangement of foam packing and internal components of FIG. 3.
Figure 6:
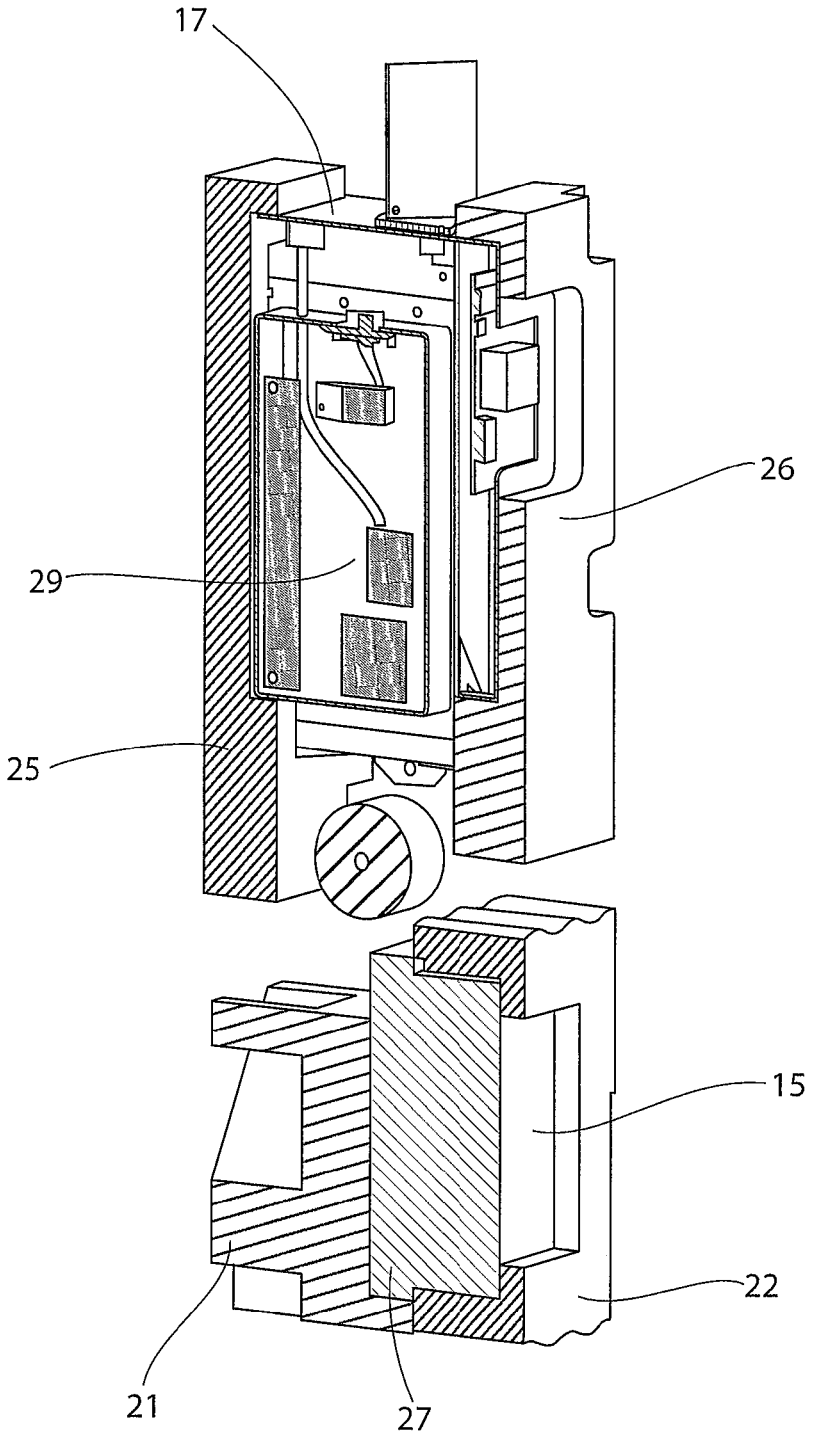
FIG. 6 is a cross-sectional view of the arrangement of foam packing and internal components of FIG. 3.
Figure 7:
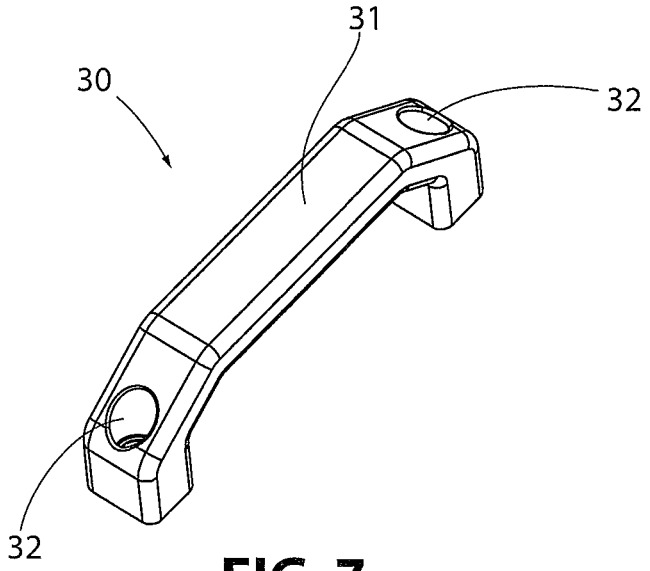
FIG. 7 is an upper perspective view of an impact resistant handle of the end of train device of FIG. 1.
Figure 8:
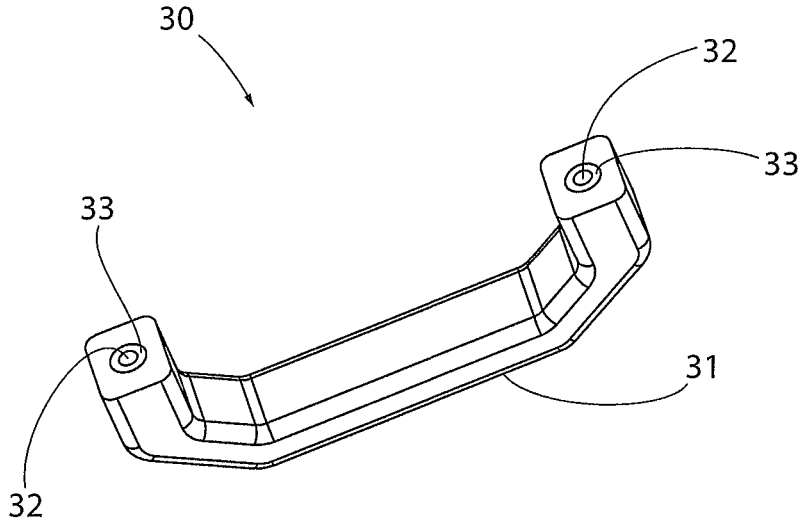
FIG. 8 is a lower perspective view of the impact resistant handle of FIG. 7.
Figure 9:
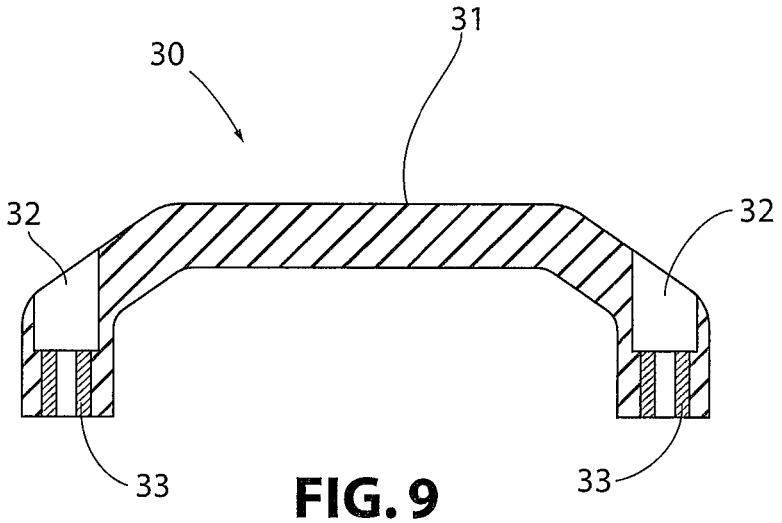
FIG. 9 is a cross-sectional view of the impact resistant handle of FIG. 7.
Figure 10:
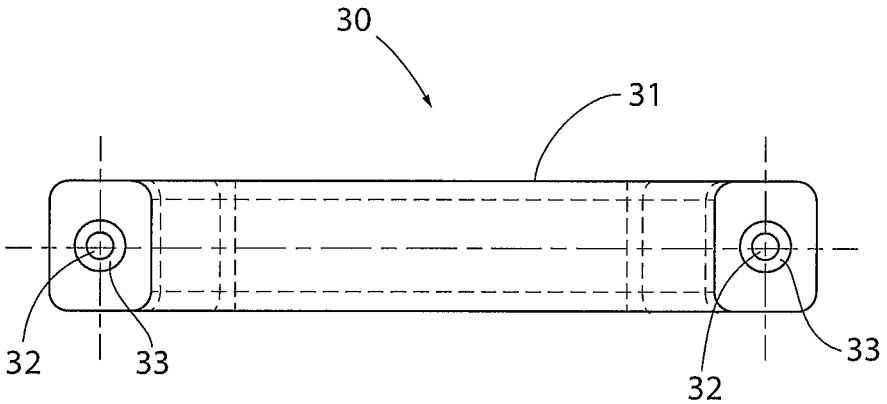
FIG. 10 is a bottom view of the impact resistant handle of FIG. 7.

With further reference to FIGS. 2-6, the protective arrangement 20 comprises a plurality of pieces of packing. In particular, the protective arrangement 20 includes at least two pieces of packing for each of the different components 15, 16, 17 housed within the hollow interior 14 of the enclosure 11. For instance, as shown in FIGS. 2, 3, 5, and 6, the protective arrangement 20 includes a first piece 21 and a second piece 22 of packing that are fitted around the battery 15 to define the compartment 27 for the battery 15. As shown in FIGS. 3 and 4, the protective arrangement 20 includes a third piece 23 and a fourth piece 24 of packing that are fitted around the generator 16 to define the compartment 28 for the generator 16. As shown in FIGS. 3, 4, and 6, the protective arrangement 20 includes a fifth piece 25 and a sixth piece 26 of packing that are fitted around the electronics module 17 to define the compartment 29 for the electronics module 17. Accordingly, the protective arrangement 20 is placed between each of the plurality of different components 15, 16, 17 and between the different components 15, 16, 17 and the hollow interior 14 of the enclosure 11 to locate, support, and protect the components 15, 16, 17. By allowing the components to float inside the enclosure 11, the components 15, 16, 17 are isolated from vibrations introduced to the EOT 10 at the coupler mount point.

As can be appreciated from FIGS. 2-6, each of the plurality of pieces of packing 21-26 is individually configured to be at least partially and in particular fully fitted around a respective different component 15, 16, 17, to cooperatively engage at least one other piece of packing 21-26 in the enclosure 11, and to cooperatively engage at least a portion of the hollow interior 14 of the enclosure 11 to at least partially and in particular completely support and isolate the respective different component 15, 16, 17 within the hollow interior 14 of the enclosure 11. To that end, the pieces of packing 21-26 may be individually formed or cut to fit together in a predetermined manner and to include various ribs, ridges, channels, ledges, and flanges for engaging each other, the different components 15, 16, 17, and the hollow interior 14 of the enclosure 11 depending upon the configuration of the EOT 10. Further, as shown in FIGS. 2-5, the pieces of packing 21-26 of the protective arrangement 20 may be individually formed or cut to accommodate ancillary components of the EOT 10. For instance, the first piece 21 of packing includes at least one groove 34 defined therein to accommodate one or more wires (not shown) within the hollow interior 14 of the enclosure 11. The pieces of packing 21-26 may also be formed to define or partially define more than one compartment 27, 28, 29. For instance, as shown in FIGS. 3-6, the fifth piece 25 and the sixth piece 26 of packing also form a portion of the compartment 28 for the generator 16. As shown in FIG. 2, the hollow interior 14 of the enclosure 11 may further incorporate elements 18, such as ledges or flanges, for engaging one or more pieces of packing 21-26 of the protective arrangement 20 to maintain the position of the protective arrangement 20, and thus the different components 15, 16, 17, within the hollow interior 14 of the enclosure 11. As such, additional fasteners and/or brackets, such as those used in traditional shock mounts, connecting the enclosure 11 to the protective arrangement 20 and/or the plurality of different components 15, 16, 17 are not needed for securing the components 15, 16, 17 in the EOT 10.

According to another embodiment of the present invention, the protective arrangement 20 includes a single piece of packing that defines multiple compartments 27, 28, 29 for each of the plurality of different components 15, 16, 17. According to yet another embodiment, the protective arrangement 20 includes one piece of packing for each of the plurality of different components 15, 16, 17 that defines the compartment for the component 15, 16, 17. The individual pieces of packing engage the inner housing 14 of the enclosure 11, but need not cooperatively engage each other.

It is to be appreciated that the pieces of packing 21-26 of the protective arrangement 20 may be formed from any material or a variety of materials known to be suitable to those having ordinary skill in the art. According to one embodiment of the present invention, the pieces of packing 21-26 are formed from a resilient foam material. In particular, the pieces of packing 21-26 are formed from closed cell polyethylene foam.

The pieces of packing 21-26 may also be formed to have different densities from each other such that the density of foam within the protective arrangement 20 can vary according to the position of the piece of packing 21-26 within the protective arrangement 20 and/or the hollow interior 14, according to the different component 15, 16, 17 fitted within the piece of packing 21-26, or according to the vibration characteristics of the EOT 10 and the mounting of the device 10 on a railcar or railcar coupling. A single piece of packing 21-26 may be formed to have a varying density across its length, width, and/or height in accordance with the same principles. According to one embodiment of the present invention, pieces of packing positioned at a lower end of the hollow interior 14 of the enclosure 11, such as the first piece 21 and the second piece 22 of packing fitted around the battery 15, have a higher density than pieces of packing positioned at an upper end of the hollow interior 14 of the enclosure 11, such as the fifth piece 25 and the sixth piece 26 of packing fitted around the electronics module 17. According to another embodiment of the present invention, the density of the pieces of packing 21-26 of the protective arrangement 20 are selected in accordance with the specific vibration characteristics of the EOT 10 and the plurality of different components 15, 16, 17 to minimize the vibration transmitted to each of the plurality of different components 15, 16, 17.

With reference to FIGS. 2-6, a method of supporting a plurality of different components 15, 16, 17 within the EOT 10 includes the steps of providing the enclosure 11 having an exterior and a hollow interior 14 housing the plurality of different components 15, 16, 17; providing the protective arrangement 20 disposed within the hollow interior 14 of the enclosure 11, the protective arrangement 20 defines a compartment 27, 28, 29 for each of the plurality of different components 15, 16, 17; fitting the protective arrangement 20 at least partially around each different component 15, 16, 17 housed within the hollow interior 14; supporting each of the plurality of different components 15, 16, 17 within the hollow interior 14 with the protective arrangement 20; and isolating each of the plurality of different components 15, 16, 17 within the hollow interior 14 of the enclosure 11 with the protective arrangement 20. The step of providing the protective arrangement 20 may include providing at least two pieces of packing 21-26 for each of the plurality of different components 15, 16, 17 and the fitting step may include fitting the at least two pieces of packing 21-26 at least partially around each of the plurality of different components 15, 16, 17 to define the compartment 27, 28, 29 for each of the plurality of different components 15, 16, 17. The method may further include the step of individually configuring each piece of packing 21-26 to be fitted around a respective one of the plurality of different components 15, 16, 17, to cooperatively engage at least one other piece of packing 21-26 in the enclosure 11, and to cooperatively engage at least a portion of the hollow interior 14 of the enclosure 11 to support the respective one of the plurality of different components 15, 16, 17 within the hollow interior 14.

The method may further include the step of selecting a particular density for each piece of packing 21-26 such that the pieces of packing 21, 22 positioned at a lower end of the hollow interior 14 of the enclosure 11 have a higher density than the pieces of packing 25, 26 positioned at an upper end of the hollow interior 14 of the enclosure. Additionally or alternatively, the method may further include the step of selecting a particular density for each piece of packing 21-26 in accordance with specific vibration characteristics of the EOT 10 and the plurality of different components 15, 16, 17.

With reference to FIGS. 1 and 7-10, the EOT 10 may further include an impact resistant handle 30 disposed on the exterior of the enclosure 11. The handle 30 has a handle body 31 that is configured to absorb impacts on the handle 30 without causing significant or substantial deformation of the enclosure 11. According to one embodiment, the handle 30 is formed from a tough, flexible material, in particular cast polyurethane, that is strong enough to provide sufficient support for carrying the EOT 10 but is also able to absorb impacts without permanently deforming and without transferring the force of the impacts to the enclosure 11, in order to protect the enclosure 11 from damage. It is to be appreciated, though, that the handle 30 may be formed from any material known to be suitable to those having ordinary skill in the art.

The handle 30 is dimensioned and fashioned as a typical carrying handle, with consideration given to the size and weight of the EOT 10 and for comfort in gripping the handle 30. To that end, texture and ergonomic grips (not shown) may be molded into the handle body 31 to increase the ease of carrying the EOT 10. Furthermore, by utilizing a softer material to form the handle 30, the handle 30 will be perceived to have a more comfortable and ergonomic grip.

As shown in FIGS. 7-10, the handle 30 includes at least one countersunk hole 32 formed in each end of the handle body 31 for use in connecting the handle 30 to the exterior of the enclosure 11. According to one embodiment, the handle 30 is fastened to the enclosure 11 via screws (not shown) disposed within the countersunk holes 32. To that end, a reinforcement bushing 33, which may be made from a metal or other suitably strong material, in particular aluminum, may be inserted into each of the countersunk holes 32 and molded into or bonded to the handle body 31 to reinforce the attachment points between the handle 30 and the enclosure 11, and to provide a bearing surface for the screws. It is to be appreciated, however, that the handle 30 may be connected to the enclosure 11 via any method or mechanism known to be suitable to those having ordinary skill in the art.

While several embodiments of an end of train device were described in the foregoing detailed description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are embraced within their scope.

The invention claimed is:

1. An end of train (EOT) device configured to be mechanically fastened to at least one end of a rail car, comprising:

an enclosure defining an exterior and a hollow interior, the hollow interior being configured to receive at least one EOT device component therein; and a protective arrangement comprising at least one piece of shaped resilient material disposed within the hollow interior of the enclosure, wherein the at least one piece of shaped resilient material comprises one or more material densities, wherein the at least one piece of shaped resilient material defines a compartment for the at least one EOT device component and is configured to be at least partially fitted around the at least one EOT device component, wherein the at least one piece of shaped resilient material is configured to completely support and mechanically isolate the at least one EOT device component within the hollow interior, and wherein the at least one piece of shaped resilient material is configured to reduce any impact from shock or vibration on the at least one EOT device component.

2. The EOT device according to claim 1, wherein the EOT device does not comprise any additional fasteners or brackets for securing the at least one EOT device component to the enclosure and the at least one piece of shaped resilient material is configured to allow the at least one EOT device component to float within the enclosure.

3. The EOT device according to claim 1, wherein the at least one piece of shaped resilient material is formed from closed cell polyethylene foam.

4. The EOT device according to claim 1, wherein the protective arrangement comprises a plurality of pieces of shaped resilient material.

5. The EOT device according to claim 4, wherein the plurality of pieces of shaped resilient material comprises at least two pieces of shaped resilient material for the at least one EOT device component, the at least two pieces of shaped resilient material being configured to define the compartment for the at least one EOT device component.

6. The EOT device according to claim 5, wherein each piece of the at least two pieces of shaped resilient material is individually configured to be at least partially fitted around the at least one EOT device component, to cooperatively engage at least one other piece of shaped resilient material in the enclosure, and to cooperatively engage at least a portion of the hollow interior of the enclosure to support the at least one EOT device component.

7. The EOT device according to claim 4, wherein at least one piece of shaped resilient material of the plurality of pieces of shaped resilient material has a different material density from at least one other piece of shaped resilient material of the plurality of pieces of shaped resilient material.

8. The EOT device according to claim 7, wherein at least one piece of shaped resilient material positioned at a lower end of the hollow interior of the enclosure has a higher material density than at least one piece of shaped resilient material positioned at an upper end of the hollow interior of the enclosure.

9. The EOT device according to claim 1, wherein a single piece of shaped resilient material has a varying material density across at least one of a height, a width, or a length of the piece.

10. The EOT device according to claim 1, wherein the protective arrangement is configured to accommodate ancillary components of the end of train device.

11. The EOT device according to claim 10, wherein the protective arrangement includes at least one groove for accommodating wires within the hollow interior of the enclosure.

12. The EOT device according to claim 1, further comprising an impact resistant handle disposed on the exterior of the enclosure, the handle being configured to absorb impacts without causing substantial deformation of the enclosure.

13. The EOT device according to claim 12, wherein the handle is formed from a flexible material.

14. The EOT device according to claim 13, wherein the flexible material is polyurethane.

15. The EOT device according to claim 12, wherein the handle includes at least one hole disposed at each end, each hole having a reinforcement bushing disposed therein for fastening the handle to the exterior of the enclosure.

16. The EOT device according to claim 1, wherein the hollow interior of the enclosure includes elements for engaging the protective arrangement to maintain a position of the protective arrangement within the hollow interior of the enclosure.

17. The EOT device according to claim 1, wherein the EOT device is configured to be attached to a coupler on the rail car.

18. A method of supporting at least one device component within an end of train (EOT) device, the EOT device being configured to be mechanically fastened to at least one end of a rail car, the method comprising:

providing the EOT device, the EOT device comprising:

an enclosure defining an exterior and a hollow interior, the hollow interior being configured to receive at least one EOT device component therein; and a protective arrangement comprising at least one piece of shaped resilient material disposed within the hollow interior of the enclosure, wherein the at least one piece of shaped resilient material comprises one or more material densities, and wherein the at least one piece of shaped resilient material defines a compartment for the at least one EOT device component;

fitting the at least one piece of shaped resilient material at least partially around the at least one EOT device component;

completely supporting and mechanically isolating the at least one EOT device component within the hollow interior of the enclosure with the at least one piece of shaped resilient material; and reducing impact from shock or vibration on the at least one EOT device component with the at least one piece of shaped resilient material.

19. The method according to claim 18, wherein the EOT device does not comprise any additional fasteners or brackets for securing the at least one EOT device component to the enclosure and the at least one piece of shaped resilient material is configured to allow the at least one EOT device component to float within the enclosure.

20. The method according to claim 18, wherein the at least one piece of shaped resilient material comprises at least two pieces of shaped resilient material and the fitting step comprises fitting the at least two pieces of shaped resilient material at least partially around the at least one EOT device component to define the compartment for the at least one EOT device component.

21. The method according to claim 20, further comprising the step of individually configuring the at least two pieces of shaped resilient material to be fitted around the at least one EOT device component, to cooperatively engage at least one other piece of shaped resilient material in the enclosure, and to cooperatively engage at least a portion of the hollow interior of the enclosure.

22. The method according to claim 18, wherein the one or more material densities comprise multiple material densities and the method further comprises the step of selecting the multiple material densities of the at least one piece of shaped resilient material such that the at least one piece of shaped resilient material has a higher material density at a lower end of the hollow interior of the enclosure than at an upper end of the hollow interior of the enclosure.

23. The method according to claim 18, further comprising the step of selecting the one or more material densities of the at least one piece of shaped resilient material in accordance with specific vibration characteristics of the EOT device and the at least one EOT device component.

24. The method according to claim 18, wherein the EOT device is configured to be attached to a coupler on the rail car.

25. An end of train (EOT) device configured to be mechanically fastened to at least one end of a rail car, comprising:

an enclosure defining an exterior and a hollow interior, the hollow interior being configured to receive a plurality of EOT device components therein; and a protective arrangement comprising at least one piece of shaped resilient material disposed within the hollow interior of the enclosure, wherein the at least one piece of shaped resilient material comprises one or more material densities, wherein the at least one piece of shaped resilient material defines a separate compartment for each of the plurality of EOT device components and is configured to be at least partially fitted around each of the plurality of EOT device components, wherein the at least one piece of shaped resilient material is configured to completely support and mechanically isolate the plurality of EOT device components within the hollow interior, and wherein the at least one piece of shaped resilient material is configured to reduce any impact from shock or vibration on the plurality of EOT device components.

26. The EOT device according to claim 25, wherein the at least one piece of shaped resilient material is formed from closed cell polyethylene foam.

27. The EOT device according to claim 25, wherein the EOT device is configured to be attached to a coupler on the rail car.

28. The EOT device according to claim 25, wherein the at least one piece of shaped resilient material comprises a plurality of pieces of shaped resilient material.

29. The EOT device according to claim 28, wherein the plurality of pieces of shaped resilient material comprises at least two pieces of shaped resilient material for each of the plurality of EOT device components, wherein the at least two pieces of shaped resilient material for each of the plurality of EOT device components are fitted around a respective EOT device component to define the separate compartment for the respective EOT device component, and wherein the at least two pieces of shaped resilient material for each of the plurality of EOT device components are configured to cooperatively engage each other and to cooperatively engage the hollow interior of the enclosure.

30. The EOT device according to claim 28, wherein at least one piece of shaped resilient material of the plurality of pieces of shaped resilient material has a different material density from at least one other piece of shaped resilient material of the plurality of pieces of shaped resilient material.

31. The EOT device according to claim 30, wherein at least one piece of shaped resilient material positioned at a lower end of the hollow interior of the enclosure has a higher material density than at least one piece of shaped resilient material positioned at an upper end of the hollow interior of the enclosure.

32. The EOT device according to claim 25, wherein the hollow interior of the enclosure includes elements for engaging the protective arrangement to maintain a position of the protective arrangement within the hollow interior of the enclosure.

* * * * *